US007309137B2

(12) United States Patent
Chan

(10) Patent No.: US 7,309,137 B2
(45) Date of Patent: Dec. 18, 2007

(54) TELESCOPING READING LIGHT

(75) Inventor: Wai Hong Chan, Teun Mun (HK)

(73) Assignee: Sunrich Manufactory Ltd., New Territories (HK)

( * ) Notice: Subject to any disclaimer, the term of this patent is extended or adjusted under 35 U.S.C. 154(b) by 31 days.

(21) Appl. No.: 10/957,125

(22) Filed: Oct. 1, 2004

(65) Prior Publication Data

US 2006/0072328 A1 Apr. 6, 2006

(51) Int. Cl.
*F21V 21/00* (2006.01)
*F21L 4/02* (2006.01)

(52) U.S. Cl. ..... 362/184; 362/198; 362/800; 362/294; 362/252; 362/190

(58) Field of Classification Search ..... 362/190, 362/191, 197, 198, 199, 184, 187, 200, 287, 362/427, 800, 294, 249, 252
See application file for complete search history.

(56) References Cited

U.S. PATENT DOCUMENTS 4,225,907 A * 9/1980 Erdell ..... 362/255
4,432,042 A 2/1984 Zeller
5,169,226 A * 12/1992 Friedman ..... 362/190
5,442,528 A 8/1995 Vandenbelt
D427,703 S 7/2000 Chan
6,565,229 B2 * 5/2003 Bliss ..... 362/198
6,736,531 B2 * 5/2004 Wallach ..... 362/414
6,896,392 B2 * 5/2005 Jigamian et al. ..... 362/202
2003/0179572 A1 * 9/2003 Schnell ..... 362/191
2005/0201085 A1 * 9/2005 Aikawa et al. ..... 362/198

* cited by examiner

*Primary Examiner*—Thomas M. Sember
(74) *Attorney, Agent, or Firm*—William J. Sapone; Coleman Sudol Sapone P.C.

(57) ABSTRACT

A portable reading light has a telescoping arm that is slidable within a housing, the arm having a light source at the end thereof which has one or more light emitting diodes which provide bright light, low power consumption and durability. The light emitting diodes preferably are located in an articulatable light support and disposed adjacent to a focusing lens to better direct and shape the light onto a surface. The arm is mounted to a base assembly slidable within the housing and being telescopically expandable for stabilizing the arm when set for use.

16 Claims, 9 Drawing Sheets

33a
33b
33c
2ϕK
2ϕK
32a
32b
32c
SECTION E- E
34
WIRE(- VE)
HEATSINK
A
B
C
E
D
35a
35b
35c
RESISTOR
WIRE(+ VE)

36a
36b
36c
HEATSINK
36
SECTION D- D 36a
33a
35a
RESISTOR
WIRE(+ VE)
WIRE(- VE)
LED 1
35°
32a
SECTION A- A
PAGE TOP
LED 1
PAGE BOTTOM 36b
33b
35b
RESISTOR
WIRE(+ VE)
WIRE(- VE)
LED 2
28.5°
32b
SECTION B- B
PAGE TOP
LED 2
PAGE BOTTOM 36c
33c
35c
RESISTOR
WIRE(+ VE)
WIRE(- VE)
LED 3
22°
32c
SECTION C- C
PAGE TOP
LED 3
PAGE BOTTOM

TELESCOPING READING LIGHT

TECHNICAL FIELD

This invention relates to a portable reading light and more particularly to a portable clip-on reading light which has a telescoping arm and improved illumination.

BACKGROUND

Portable clip-on reading lights are known. For example, a book light such as that disclosed in U.S. Pat. No. 4,432,042 has a base, an integral clamp from which a vertical lamp bearing arm is mounted to one end with the other end supported by the base. These devices typically comprise a body having means to clip on to a surface, such as a book cover, and include an arm that may be flexible or foldable for aligning a light for illuminating, for example, a page of a book.

Generally, such lights are popular but they do suffer from several drawbacks. Typically, illumination is provided by an incandescent bulb which itself has a limited life and such bulbs are often sensitive to shock during handling and are also difficult to replace. The sensitivity to shock promotes early bulb failure. In addition, power consumption is rather high which may result in reduced battery life and therefore frequent battery replacement. Often, the bulb is somewhat underpowered and therefore the amount of illumination may dim significantly over time leading to possible eye strain. Lastly, while folding and bending arms are useful, these do require additional space and any effort to reduce the size or bulkiness of the portable reading light promotes its portability and convenience for the user.

SUMMARY OF THE INVENTION

It is an object of the invention to provide a clip-on reading light with increased bulb life.

It is a further object to provide a clip-on reading light which has increased battery life.

It is yet another object to provide a clip-on reading light with improved illumination.

It is yet another object to provide a clip-on reading light that is compact and light weight.

These and other objects of the present invention are achieved by a portable reading light having a housing, a power source disposed in the housing, a telescoping arm having an articulatable light source at the outer end thereof, the arm being mounted on a base, slidable within the housing for storing the telescoping arm therein. The light source comprises at least one light emitting diode (LED). Preferably, a magnifying lens is located adjacent the LED for directing and focusing the light emitted therefrom. The housing has means for clipping onto the surface of an object. Preferably, the light source comprises a plurality of light emitting diodes, most preferably three LEDs, which are set at specific angles relative to each other and disposed adjacent one or more magnifying lens which focus and direct the light for improved illumination.

Utilizing the present invention, a compact portable reading light is provided with an articulatable light that not only illuminates a page but which is rugged, and is low power consuming yet provides particularly bright white light without substantial dimming, for promoting long term reading with limited eye strain. Incorporating the telescoping arm within the housing also provides a compact device since the arm is stored within the housing when not in use.

DETAILED DESCRIPTION OF THE INVENTION

Figure 1A:
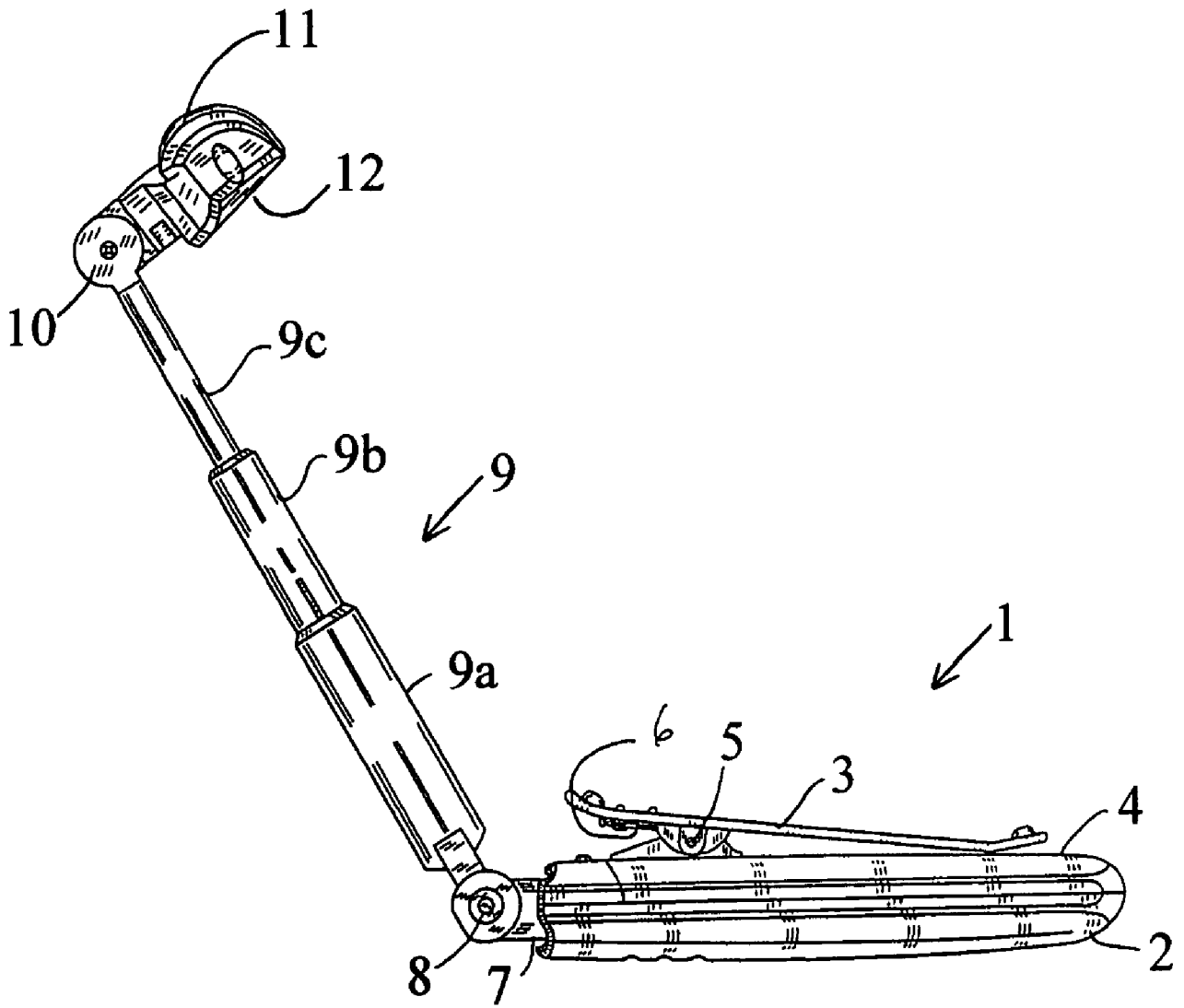
FIG. 1*a* is a side view of the portable reading light of the present invention with the telescopic arm extended.
Figure 1B:
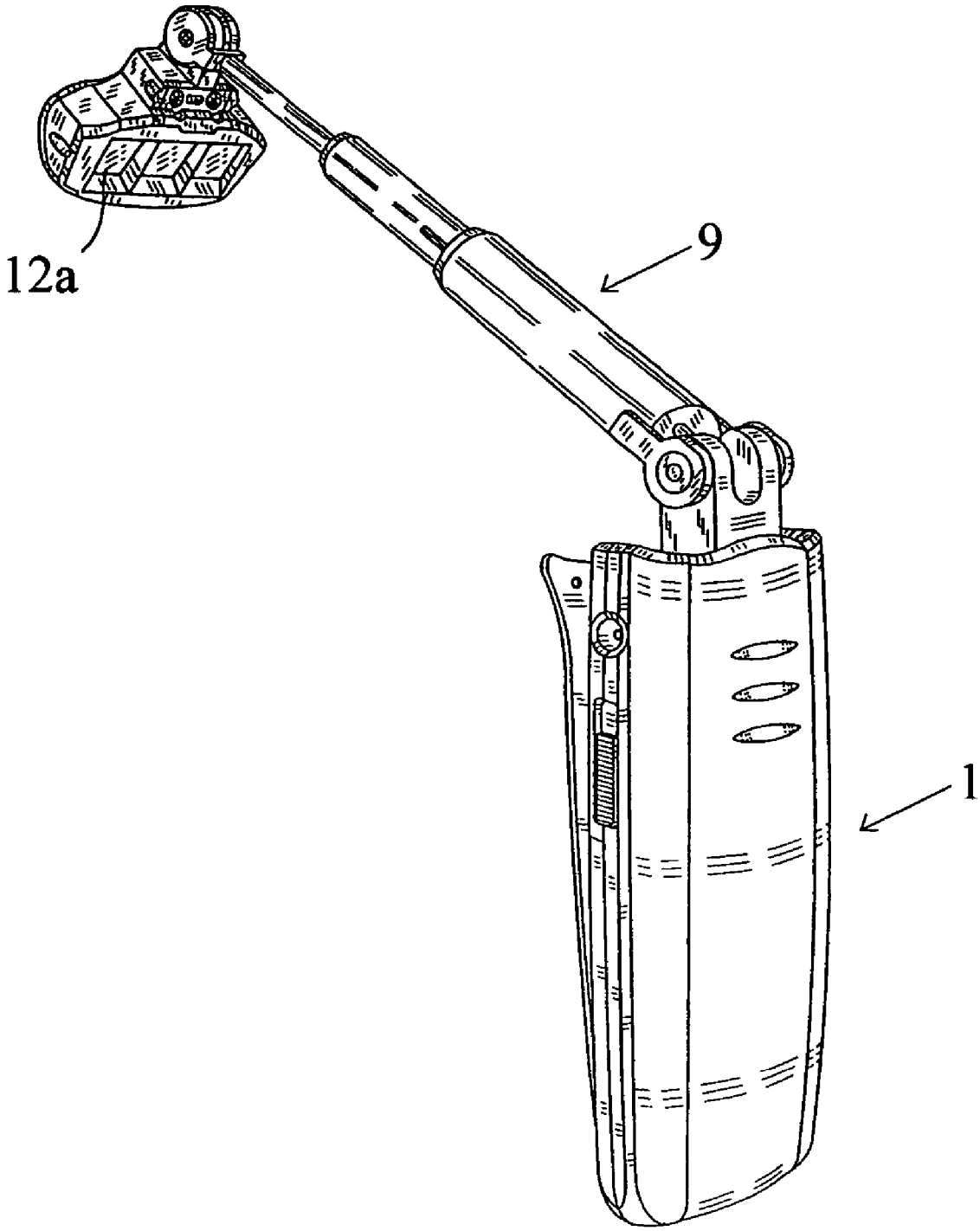
FIG. 1*b* is a perspective view showing the portable reading light from an alternate angle.

Referring to FIG. 1*a*, a portable reading light 1 has a housing 2 having a clip 3 on a side 4 thereof. The clip pivots on a hinge 5 and is biased by a spring 6. The light has a slidable base 7 with a pivot 8 supporting a telescoping arm 9 which has three sections, 9A, 9B and 9C. An outer pivot 10 is located at an outer end of the arm section 9*c* and has a light support 11 rotatably mounted thereto, within which are disposed three light emitting diodes 12. In FIG. 1*a*, the portable reading light is shown extended for use. FIG. 1*b* shows the extended light at an alternate angle, the light emitting diodes 12 and disposed behind individual magnifying lenses 12*a* which focus the light to improve lighting on the surface illuminated as will be described further below. Using directed light significantly improves readability over the use of LEDs alone.

Figure 2:
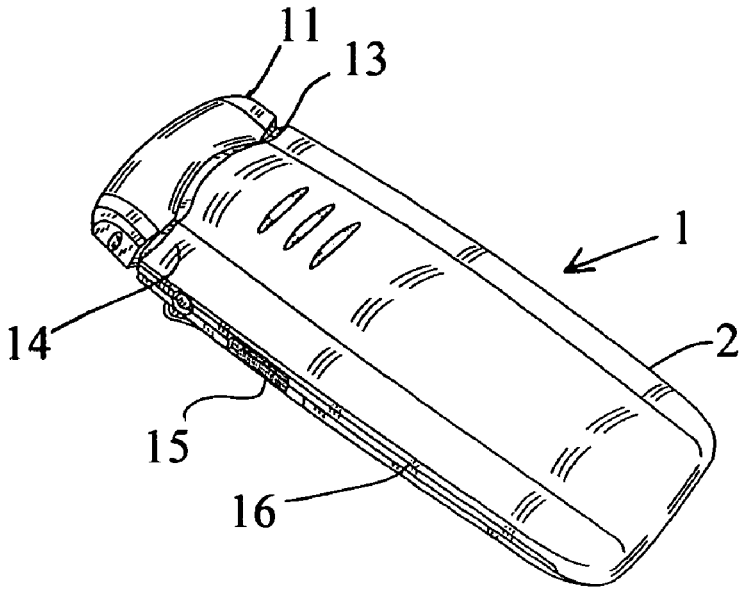
FIG. 2 is a top perspective view of the portable reading light with the arm collapsed and stored in the housing.
Figure 5C:
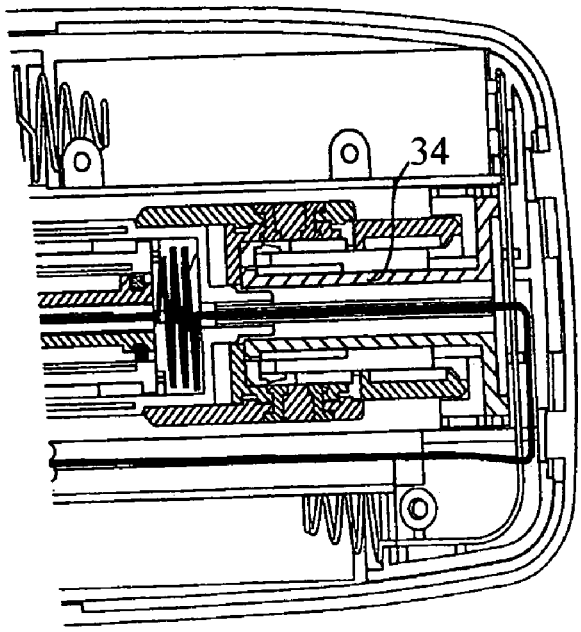
FIG. 5*c* is a view with the block collapsed within the housing.

Referring to FIG. 2, the portable reading light 1 has the arm 9 stored within the housing 2, and the light support 11 received within a socket 13 at a forward end 14 of the housing. Thus, the portable reading light is shown in a compact form for storage. A sliding switch 15 is provided on a side 16 of the housing for ease in actuating the light. In this position, the portable reading light can function as a flashlight.

Figure 3:
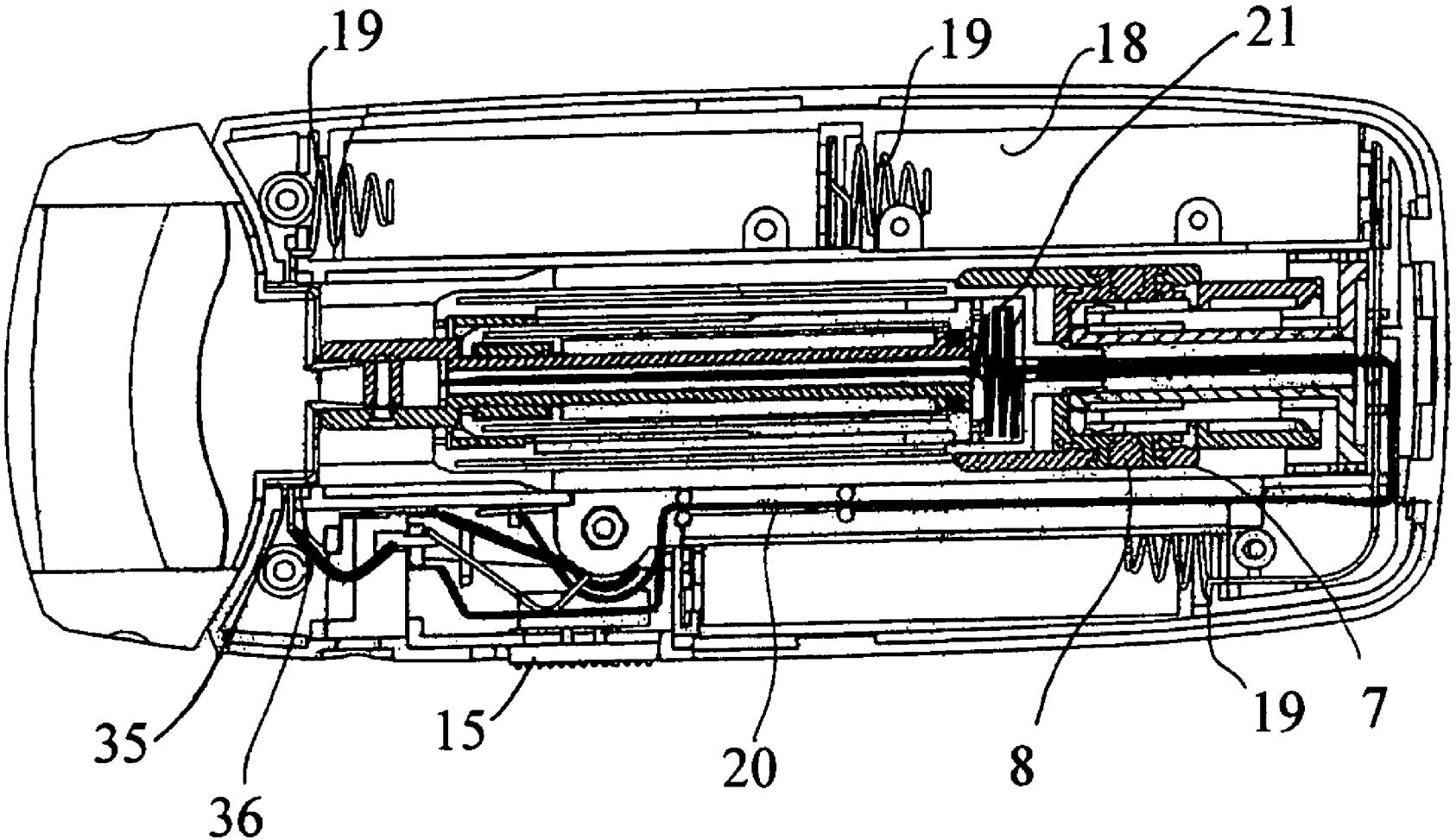
FIG. 3 is a cross-sectional view of the portable reading light with the arm collapsed within the housing.

Referring to FIG. 3, the reading light housing 2 is shown in cross-section. A power source 17 is located within the housing 2 for powering the light. While various configurations are possible, in this embodiment, 3 AAA size battery receiving slots 18 are provided and interconnected by conductors 19 to the switch 15. The switch is slidable, having on and off positions. A flexible pair of conductors, shown as a single wire 20, pass from the switch to and through the arm 9 which includes a wire storage chamber 21 therein. The wire storage chamber is sized for receiving a sufficient length of wire as would be needed for connecting to the light source when the telescoping arm is in the extended position.

When the telescoping arm is collapsed, the wire bunches or coils within the chamber. Sufficient wire must be provided to reach the bulbs in the lamp support when in the extended position.

Figure 4:
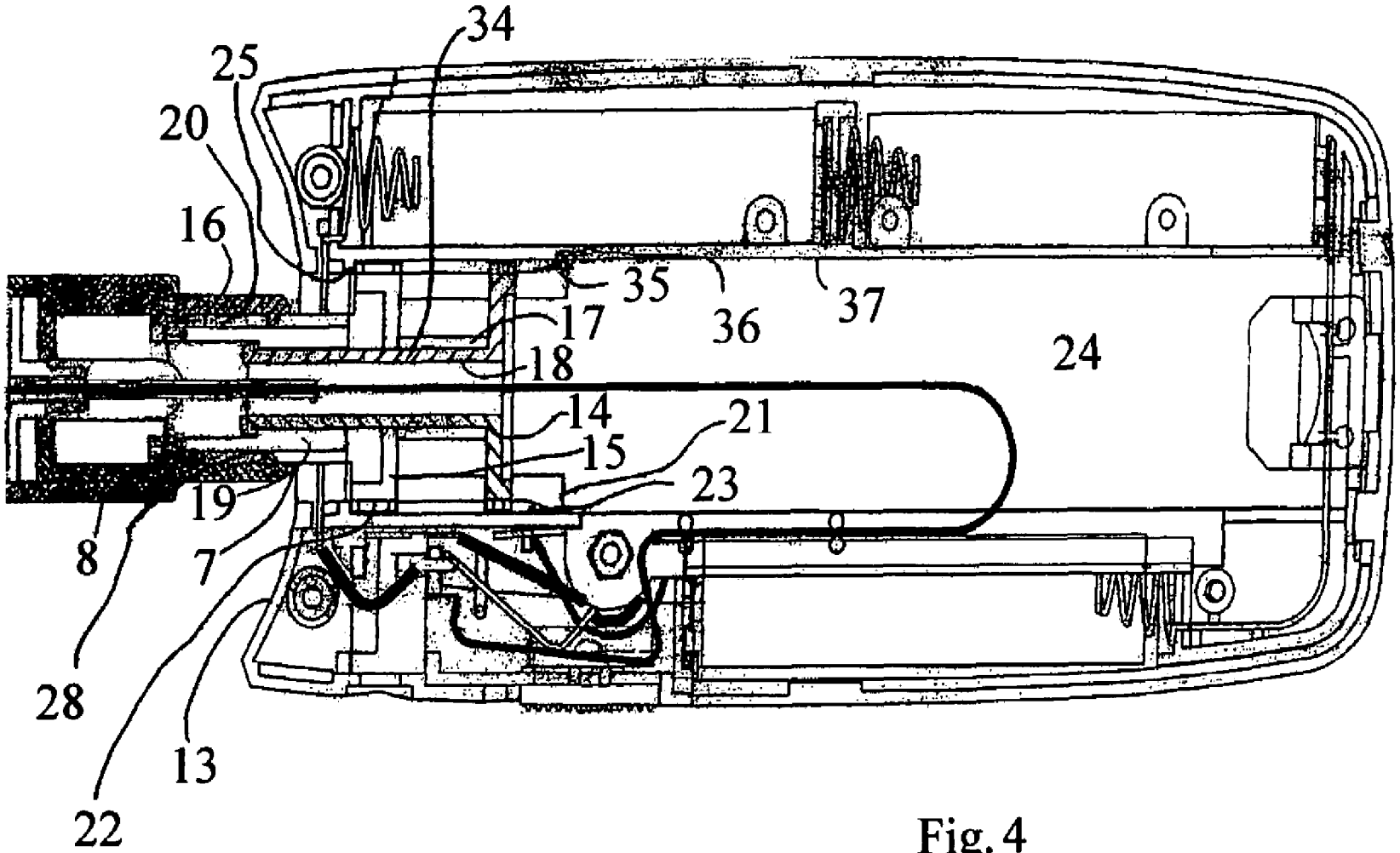
FIG. 4 is a cross-sectional view of the portable reading light with the arm extended outside of the housing.

Referring to FIG. 4, the arm 9 is fully out of the housing 2. The slide block 7 is positioned adjacent to the lamp support receiving socket 13 at the forward end of the housing. The slide block is an assembly of three components including a first base 14 having a section slidable within a second base 15 slidable within a third base 16. The bases collapse together when set for storage but extend when in use to add stability to the extended arm. The first base 14 has slots 17 on each side 18. The slots 17 are received in corresponding slots 19 in the second base 15. Similarly, within the third base 16, the pivot portion 8 has slots 20 for receiving the second base but only when the arm is coaxially aligned, so that the arm is locked in this position when the second base is received within the third base. Each of the first and second bases have a responsive projection 21 and 22 that ride on rails 23 disposed on opposite sides of an arm receiving chamber 24 within the housing. A stop 25 is provided at the forward end of the rails to stop the forward movement of the base, so that it does not exit the housing. Each of the second and first bases have downwardly projecting prongs 26 that are received in a pair of grooves 27 within the housing. The grooves provide stability for the arm as well. The third base similarly has prongs 28 that slide within the slots of the second base.

In operation, these bases slide into each other to form a compact slidable block when the arm is stored within the housing, but have an extended form when the arm is pulled out of the housing.

Figure 5A:
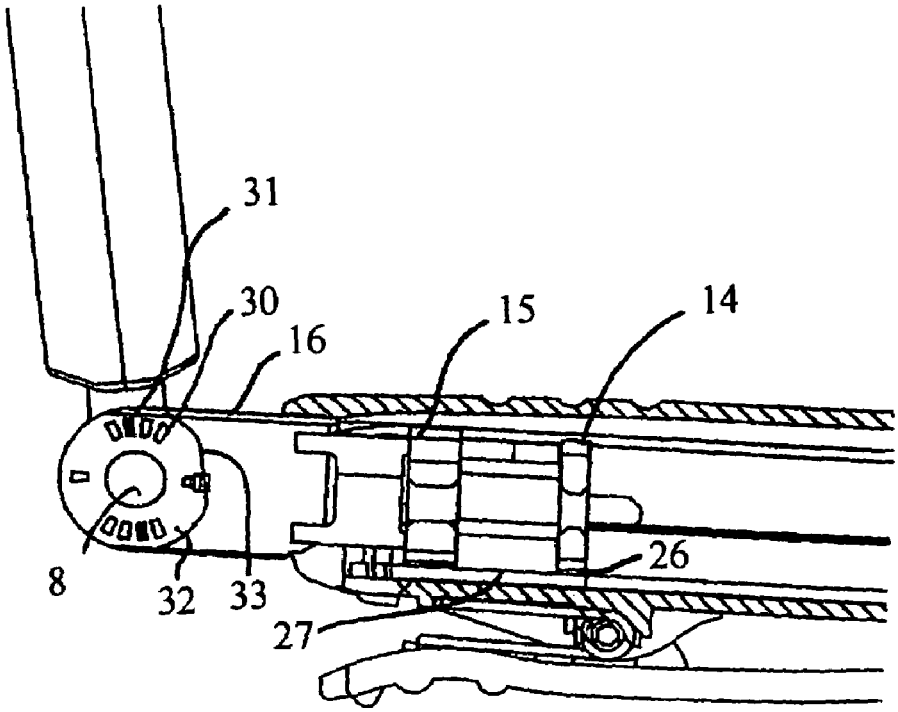
FIG. 5*a* is an enlarged cross-sectional view of the arm pivot.
Figure 5B:
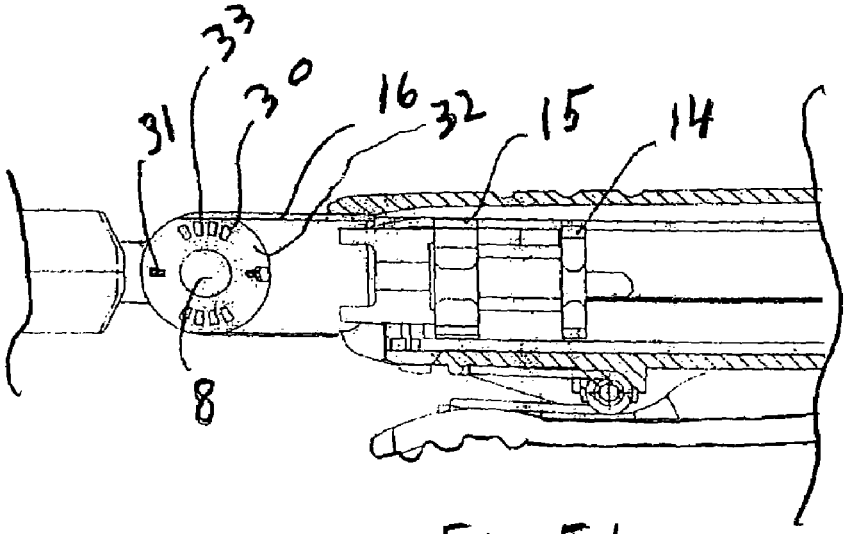
FIG. 5*b* is a cross-sectional view with the arm coaxial with the housing.

Referring to FIG. 5*a-b*, the pivot 8 is shown in cross section, with the bases fully extended. The pivot itself has detents 30 that receive stops 31 for providing a ratchet type pivoting, that is, the pivot moves in increments. This prevents slippage of the light from the optimum angle set by the user. The pivot has a circular support 32 with a flat side 33 for locking the pivot in the coaxial position for storage. A cylinder portion 34 extends through the second and third bases for additionally locking the pivot for storage.

Two projections 35 are received within detents 36 disposed in supporting the opposed side walls 37 within the housing so as to semi-permanently lock the slide block in position when the lamp is in the received position.

Referring to FIG. 5*b*, the pivot 8 for the arm 9 is engaged to the base, having a plurality of slots 30 that act as stops for receiving a pair of projections 31 extending from a rotating portion of the pivot. These slots receive the projections therein so as to semi-permanently lock the arm in different angular positions to allow the user to set the arm at particular angles for reading and thereby prevent the arm from pivoting inadvertently. The projections and slots lock in a sufficient amount to prevent rotation of the arm, yet allow the locking to be overcome by manual pressure when the arm is manipulated for storage.

Figure 6:
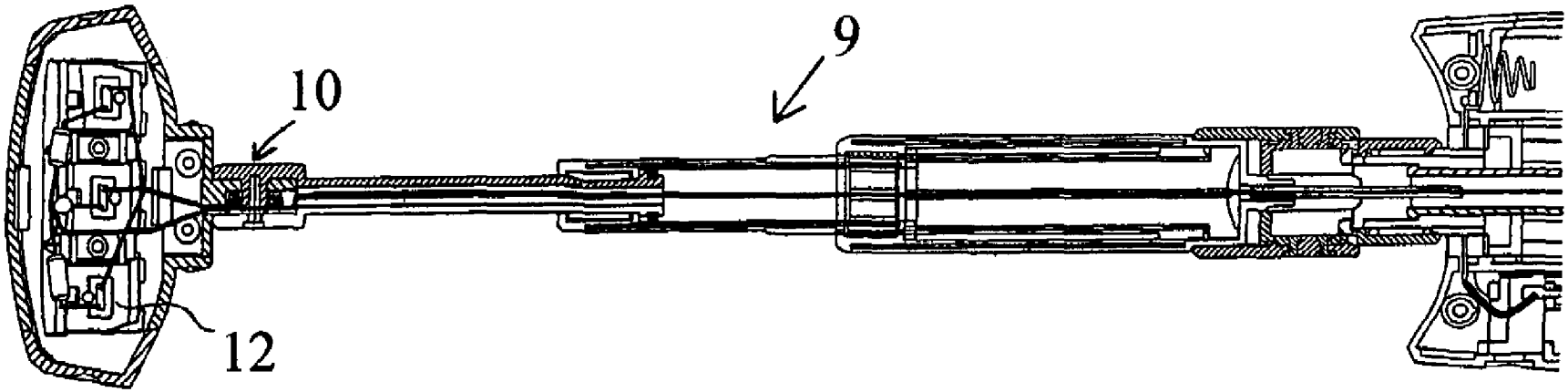
FIG. 6 is a cross-sectional view of the arm in the extended position.

Referring to FIG. 6, the arm is extended, with the bulbs 12 in the lamp support connected to the power supply in the housing. Similar slots and projections are used to lock the lamp support in the socket in the housing and to lock the base in the forward most position.

The light emitting diodes alone do not provide satisfactory lighting for reading as the light emitted from the diode has a directivity angle. The angle either focuses the light in a bright circular spot or scatters the light for greater illumination coverage but with a loss of light intensity, as either the light is uneven, or too diffused for successful use as a reading light.

Figures 7, 7D, 7E:
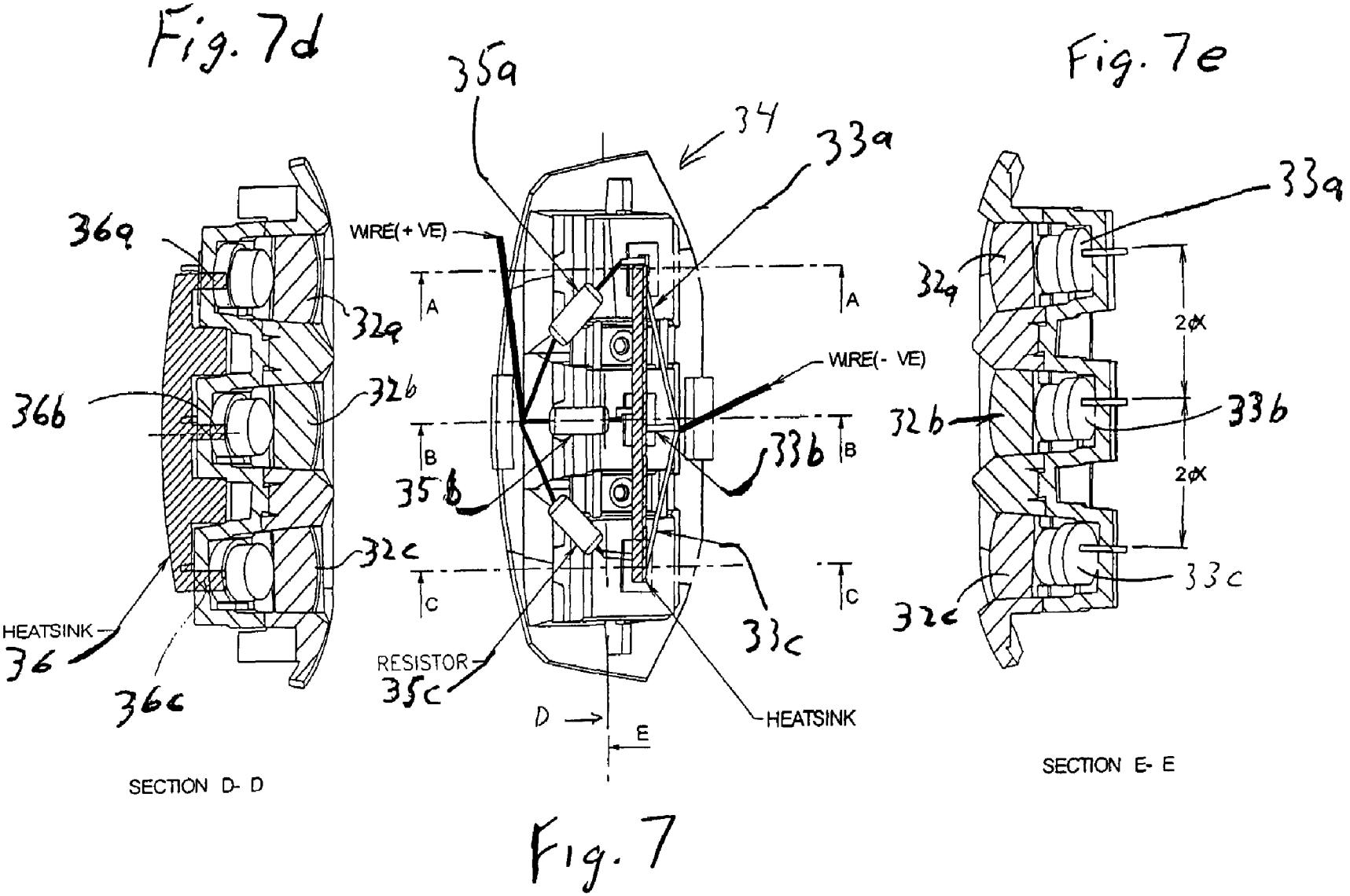
FIG. 7 is a top view of the lamp support assembly of the present invention.
FIG. 7*d* is a view taken along line D-D thereof and FIG. 7*e* is a view taken along line D-D thereof and FIG. 7*e* is a view taken along line E-E thereof.

Referring to FIGS. 7-7*e*, the present invention overcomes these deficiencies by incorporating a magnifying lens 32 adjacent to an LED 33 which captures the light emitted and changes the directivity angle and converts it preferably to a closely rectangular shape, increasing the efficiency for illuminating a specific area of a reading page. The lens spreads the light which would otherwise be too concentrated on a focal point, while avoiding over diffusion of the light to too large of an area. If not filtered by the lens, the light is also too white which results in too much reflection back to the reader, which is annoying and may strain and tire the eyes.

Figures 7A, 7B, 7C, 8A, 8B, 8C:
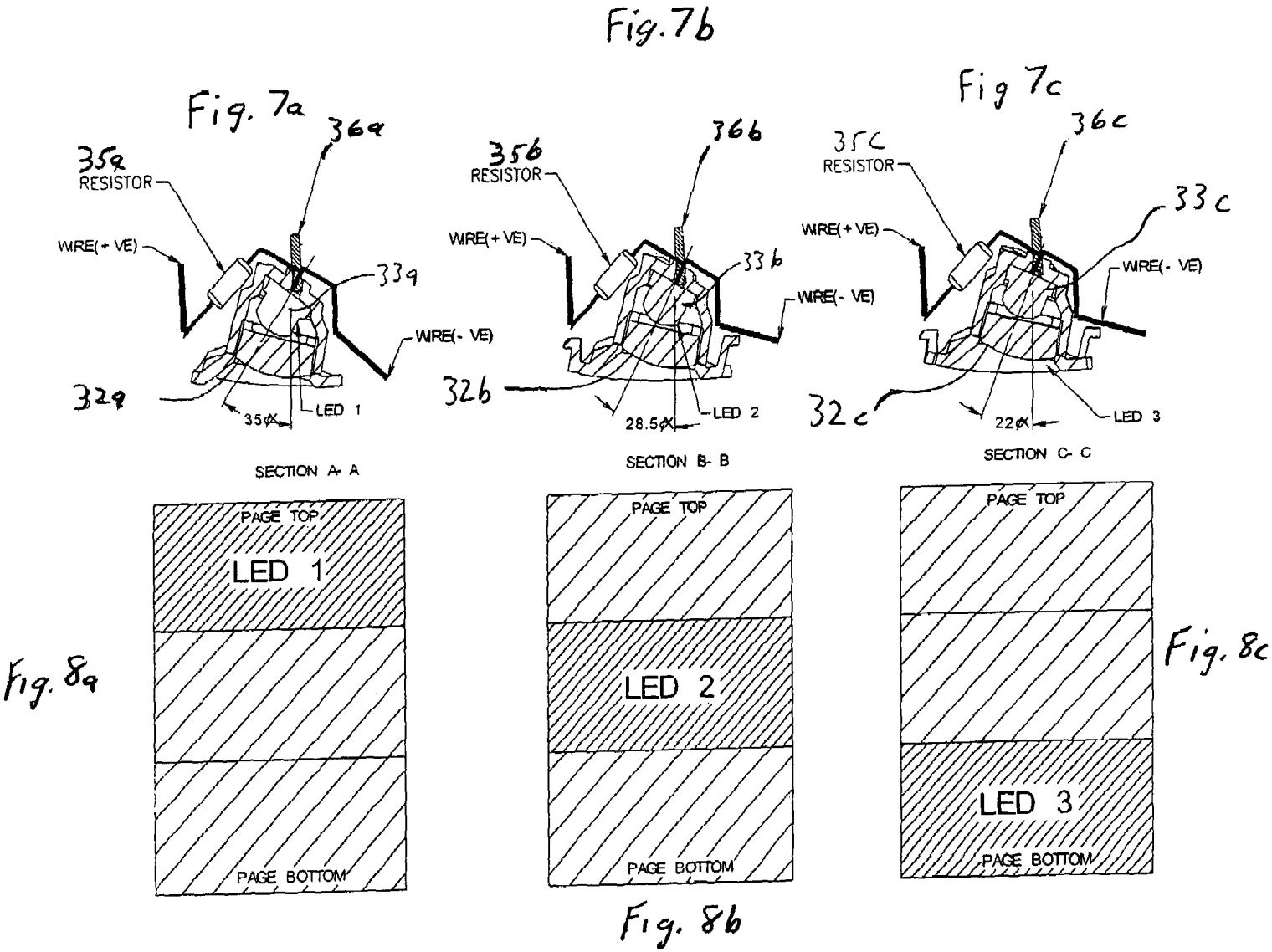
FIG. 7*a* is a view taken along line A-A thereof.
FIG. 7*b* is a view taken along line B-B thereof.
FIG. 7*c* is a view taken along line C-C thereof.
FIGS. 8*a-c* are views showing how each LED illuminates a specific page portion, relative to its angle in the lamp support.

As seen in FIG. 7, a lamp support 34 has three light emitting diodes 33*a, b* and *c* each of which is set at a specific angle. As shown in FIGS. 7*a*, 7*b* and 7*c*, these are 35, 28.5 and 22 degrees, respectively though other angles could also be used. As shown in FIGS. 8*a*, 8*b* and 8*c*, placing the LED's at these angles, and illuminating through the associated lenses 32 *a, b* and *c*, provides illumination of a full page, each LED illuminating a particular portion of the page.

One or more magnifying lenses can be used with one or more single or multiple LED configurations. However, one LED may be insufficient to provide even light distribution on a page, and about three LED's are preferred in one embodiment, the magnifying lens may be adjusted so that the light overlaps from each LED on or about the same rectangular space, providing an additive effect. This may be useful for longer extension embodiments.

Alternatively, and preferably, each LED can be focused on different portions of a page, so as to cover more area, for example, one covers the top of a page, a second covers a middle of a page and a third covers a bottom of a page. The direction and area covered are a function of the magnifying/focusing lens design. This works quite well with the telescoping arm, as adjusting the distance of the light source from the page allows a user to adjust the area covered, as well as intensity.

The circuitry for powering the LED's preferably includes means to enhance LED life. In one embodiment, each LED 33 *a, b* and *c* has a resistor 35 *a, b* and *c* which prevents overloading the LED's with too much voltage or current. In addition, each LED has an associated heatsink 36 *a, b* and *c* which are integrated into a simple heatsink to draw heat away from the LED's and prevent damage from overheating. Preferably, a single heat sink 36 is used for all the LED's.

While preferred embodiment of the present invention have been shown and described it will be understood by those skilled in the art that various changes or modification could be made without varying from the scope.

What is claimed is:

1. A portable reading light having a housing, a power source disposed in the housing, a telescoping arm having an articulatable light source at an outer end thereof, and being mounted on a base assembly, slidable within the housing for storing the telescoping arm therein, the light source being at least one light emitting diode, the housing having clip means on a surface thereof for clipping to an object, an articulatable light support for holding the light source and at least three light emitting diodes, at least one magnifying lens disposed adjacent to the at least three light emitting diodes for focusing the light therefrom on selected space for focusing the light from each light emitting diode on a different selected space.

2. The portable reading light of claim 1 further comprising resistor means associated with the at least one light emitting diode for limiting over voltage or over current power flow to the at least one light emitting diode.

3. The portable reading light of claim 1 further comprising a heatsink disposed adjacent to the at least one light emitting diode to draw heat away therefrom to prevent overheating thereof.

4. A portable reading light having a housing, a power source disposed in the housing, a telescoping arm having an articulatable light source at an outer end thereof, and being mounted on a base assembly, slidable within the housing for storing the telescoping arm therein, the light source being at least one light emitting diode, the housing having clip means on a surface thereof for clipping to an object, an articulatable light support for holding the light source and at least three light emitting diodes, at least one magnifying lens disposed adjacent to the at least three light emitting diodes for focusing the light from each LED to different selected spaces.

5. The portable reading light of claim 4 wherein the base assembly comprises the first base section, slidable within a second base section, slidable within a third base section to form an extended base assembly when at a forward end of the housing, and a compact base assembly when at a rearward end of the housing.

6. The portable reading light of claim 5 wherein the base assembly has means to slide within the housing.

7. The portable reading light of claim 4 wherein the telescoping arm has three telescoping portions.

8. The portable reading light of claim 4 further comprising a power supply disposed in the housing.

9. The portable reading light of claim 4 further comprising switch means for activating the light source.

10. The portable reading light of claim 4 wherein the telescoping arm is mounted to the base assembly by a first pivot assembly.

11. The portable reading light of claim 4 wherein the light source is mounted to the telescoping arm by a second pivot assembly.

12. The portable reading light of claim 4 wherein the housing has a central channel for receiving the telescoping arm therein.

13. The portable reading light of claim 10 wherein the first pivot assembly comprises a circular support having a flat surface and having a plurality of slots for receiving one or more projections for locking the arm at a selected angle.

14. The portable reading light of claim 4 further comprising an articulatable light support for holding the light source and at least one magnifying lens disposed adjacent to the at least one light emitting diode.

15. The portable reading light of claim 4 further comprising resistor means associated with the at least one light emitting diode for limiting over voltage or over current power flow to the at least one light emitting diode.

16. The portable reading light of claim 4 further comprising a heat sink disposed adjacent to the at least one light emitting diode to draw heat away therefrom to prevent overheating thereof.

* * * * *